United States Patent [19]

Ishikawa

[11] Patent Number: 4,594,925

[45] Date of Patent: Jun. 17, 1986

[54] APPARATUS FOR CUTTING A SLIDE FASTENER CHAIN

[75] Inventor: Kiichiro Ishikawa, Marietta, Ga.

[73] Assignee: Yoshida Kogyo K. K., Tokyo, Japan

[21] Appl. No.: 671,224

[22] Filed: Nov. 14, 1984

[51] Int. Cl.[4] ..... B26D 5/28

[52] U.S. Cl. ..... 83/209; 83/364; 83/371; 83/921

[58] Field of Search ..... 83/42, 209, 210, 364, 83/371, 921

[56] References Cited

U.S. PATENT DOCUMENTS

| | | | |
|---|---|---|---|
| 2,581,937 | 1/1952 | Secrest | 83/209 |
| 2,738,007 | 3/1956 | Power et al. | 83/364 X |
| 2,754,908 | 7/1956 | Proud | 83/364 X |
| 3,011,375 | 12/1961 | Muller | 83/364 X |
| 3,029,675 | 4/1962 | Alexander | 83/371 X |
| 3,599,521 | 8/1971 | Lee | 83/364 X |
| 3,776,078 | 12/1973 | Perlman | 83/210 |
| 4,043,232 | 8/1977 | Jovin | 83/921 X |

FOREIGN PATENT DOCUMENTS

| | | | |
|---|---|---|---|
| 1022157 | 3/1966 | United Kingdom | 83/209 |

*Primary Examiner*—James M. Meister

*Attorney, Agent, or Firm*—Hill, Van Santen, Steadman & Simpson

[57] ABSTRACT

For severing a continuous slide fastener chain into individual slide fastener lengths, the chain having succesive coupling element portions and element-free gap sections on a stringer tape, a cutting station is preceded by a detecting unit. The detecting utilizes at least two sensors for sensing the leading end of each successive coupling element portion of the chain which is being conducted to the cutting station. The sensors are longitudinally spaced along the chain's path to the cutting station and produce respective command signals one after the other to a chain drive to reduce the moving rate of the chain in step fashion to a low speed as the gap section approaches the cutting station. This enables uniform and adequate quality fastener length cutting to be reliably achieved.

11 Claims, 22 Drawing Figures

FIG. 10
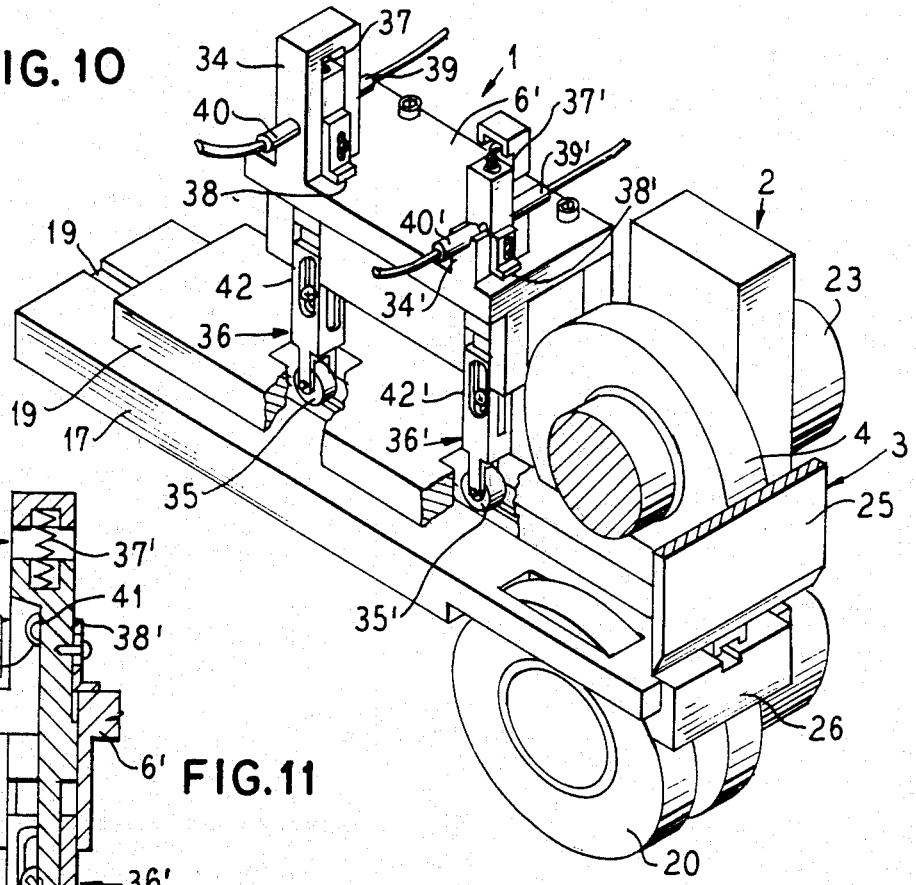
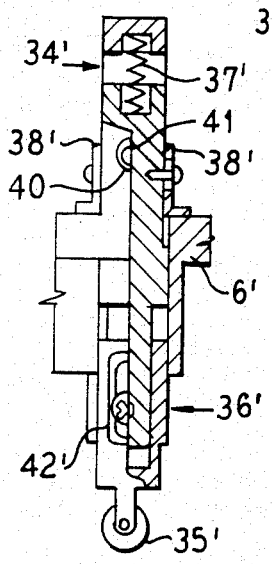
FIG. 11
FIG. 12
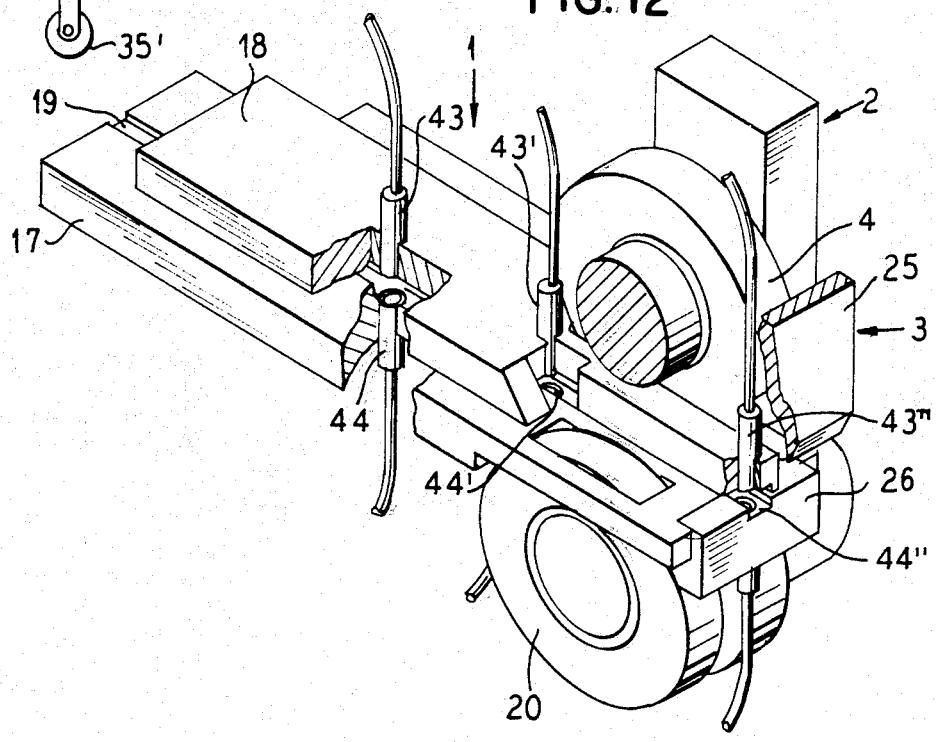

APPARATUS FOR CUTTING A SLIDE FASTENER CHAIN

BACKGROUND OF THE INVENTION

1. Field of the Invention

The present invention relates to the production of slide fasteners, and more particularly to a method and apparatus for automatically cutting a continuous slide fastener chain at longitudinally spaced successive element-free gap sections into individual slide fastener lengths.

2. Prior Art

U.S. Pat. No. 2,754,908 discloses an apparatus for automatically cutting a continuous slide fastener chain at longitudinally spaced successive element-free gap sections into individual slide fastener lengths. In this apparatus, the fastener chain is moved intermittently to a cutting station so that the movement of the fastener chain is halted every time each element-free gap section arrives at the cutting station. A cutting knife means, having coacting upper and lower blades, is disposed in the cutting station to sever the fastener chain across the successive element-free gap sections one after another in synchronization with intermittent movement of the fastener chain. The periodic termination of movement of the fastener chain is triggered by means of a pivotable stop member horizontally extending beneath the path of the fastener chain and having an upwardly angled tip end. The stop member is also horizontally movable between a first position upstream of the cutting station and a second position in the cutting station. Upon arrival of one of the successive element-free gap sections at the first position, the stop member is pivotally biased so that the tip end is inserted into the gap section, which is a space between a pair of opposed blank tape portions. The leading end of the succeeding pair of coupled fastener element then comes into engagement with the tip end of the stop member as the chain then continues its movement so that the stop member is moved to the second position in the cutting station. Movement of the stop member to its second position causes a switch to be actuated to terminate the movement of the fastener chain. The upper blade is then lowered to coact with the lower blade to sever the fastener chain across the element-free gap section.

One disadvantage with this apparatus is that, since the tip end of the stop member remains in the element-free gap section during this severing, the region at which the element-free gap section of the fastener chain can be severed is confined to only a limited region of the gap section.

Another problem with this prior art apparatus is that the endmost coupled elements or a bottom stop at the leading end of the succeeding pair of coupling elements would tend to be damaged by the tip end of the stop member. Further, there would be a danger that an accidental separation would occur along the leading end portion of the succeeding pair of coupling elements, causing inaccurate termination of the movement of the fastener chain. Consequently, uniform and adequate quality slide fasteners are difficult to achieve reliably with this prior art apparatus.

The present invention overcomes these drawbacks with such prior apparatus, such that element-free gap sections in a continuous slide fastener chain can be severed at any point therealong (even near the leading end of a succeeding pair of coupling elements) and the possibility of damage to or accidental separation of the endmost coupling elements or damage to a bottom end stop at the leading end of a succeeding pair of coupling elements is avoided, assuring uniform and adequate quality slide fasteners are produced.

SUMMARY OF THE INVENTION

For automatically severing a continuous slide fastener chain, which has successive spaced element-free gap sections between longitudinally spaced successive opposed pairs of interengaged fastener coupling elements strips, there is disclosed an inventive method and apparatus. The chain is moved along a longitudinal path through first a detecting station and then a cutting station. In the detecting station, there are two sensing means for sensing the leading end of each successive pair of coupling element groups at two longitudinally spaced positions to produce respective command signals one after the other to a fastener-chain moving means to reduce the moving rate of the fastener chain in step fashion, from a high speed to a low speed as the preceding element-free gap section approaches the cutting station. The element-free gap section is then halted in the cutting station at a predetermined position therealong and severed. The sensing means can be in various forms, but do not extend into the cutting station and can not interfere with the severing operation taking place in the cutting station.

One object of the present invention is to provide a method and apparatus for automatically cutting a slide fastener chain at successive spaced element-free gap sections one at a time into individual slide fastener lengths, in which each element-free gap section can be severed at any region even near the leading end of a succeeding pair of coupled elements.

Another object of the invention is to provide a method and apparatus for automaticaly cutting a slide fastener chain into individual slide fastener lengths, in which each element-free gap section can be placed accurately in a predetermined position in the cutting station without any damage to the endmost coupling elements or a bottom and stop near the leading end of the succeeding pair of coupling elements.

A still further object of the invention is to provide a method and apparatus for automatically cutting a slide fastener chain into a slide fastener lengths, in which accurate termination of the movement of the fastener chain can be effected without accidental separation along the leading end portion of the succeeding pair of coupling element groups, guaranteeing uniform and adequate quality slide fasteners.

Other advantages, features and additional objects of the present invention will become manifest to those versed in the art upon making reference to the detailed description and accompanying drawings in which several preferred embodiments incorporating the principles of the present invention are shown by way of illustrative example.

BRIEF DESCRIPTION OF THE DRAWINGS

FIG. 10 is a perspective view, with parts broken away, of another cutting apparatus, showing a modification of the detecting unit;

FIG. 11 is a fragmentary front elevational view, partly in cross section, of the detecting unit of FIG. 10; and FIG. 12 is a perspective view, with parts broken away, of a cutting apparatus, showing another modification of the detecting unit.

DETAILED DESCRIPTION OF THE PREFERRED EMBODIMENTS

The present invention concerns cutting or severing of a continuous slide fastener chain F, into individual slide fastener lengths of various types, as the result of a novel method and apparatus. A slide fastener chain F is formed of a pair of continuous stringers, each having successive longitudinally spaced groups of coupling elements E mounted on a continuous stringer tape T along an inner longitudinal edge thereof. The coupling elements E of one stringer tape T are interengaged with opposed complementary groups of coupling elements E on the other stringer tape T; and there are longitudinally spaced successive element-free gap sections S between the successive spaced pairs of coupling element groups E.

Figure 5A:
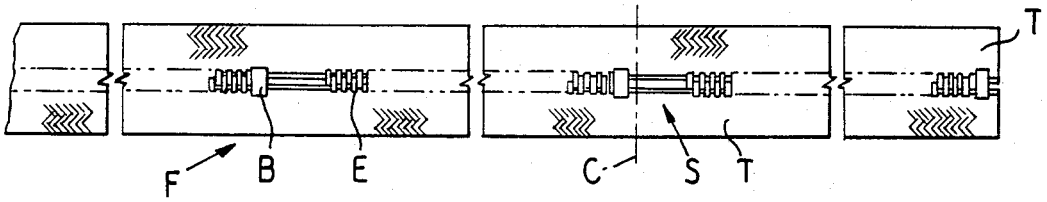
FIG. 5A is a fragmentary plan view of a slide fastener chain to be cut into individual slide fastener lengths according to the present method and apparatus.
Figure 6A:
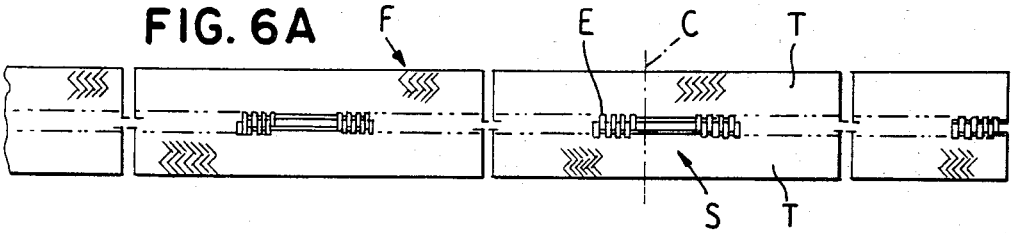
FIG. 6A is a view similar to FIG. 5A, showing a modified slide fastener chain.
Figure 7A:
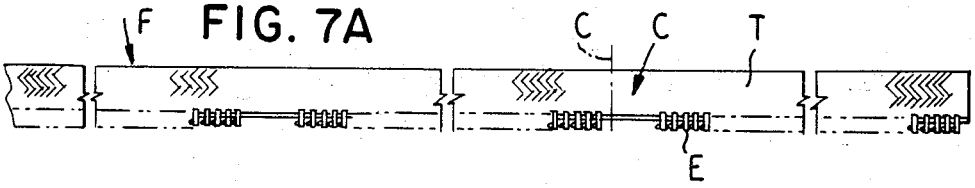
FIG. 7A is a fragementary plan view of a continuous stringer to be cut into individual slide fastener lengths according to the present method and apparatus.

As shown in FIG. 5A, a fastener chain F may also have a plurality of bottom end stops B, each attached to the leading end of a respective one of the successive spaced pairs of interengaged coupling element groups E. FIG. 6A shows another slide fastener chain F of the same construction as that of FIG. 5A except that no bottom end stops B are attached to the fastener chain F. FIG. 7A shows a continuous length of stringer, i.e. one tape half of the slide fastener chain F of FIG. 6A. Alternatively a plurality of sliders (now shown) may be threaded one on each of the successive pairs of coupling element groups E of the fastener chain F of FIGS. 5A or 6A.

Figure 5B:
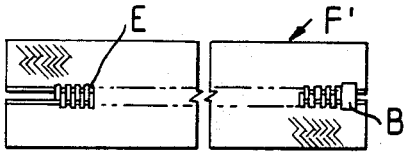
FIG. 5B shows a slide fastener length of a pair of stringers having been cut from the slide fastener chain of FIG. 5A.
Figure 6B:
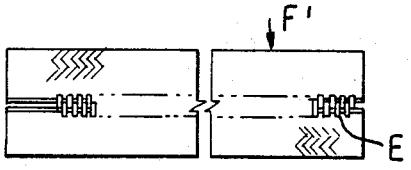
FIG. 6B shows a slide fastener length of a pair of stringers having been cut from the slide fastener chain of FIG. 6A.
Figure 6C:
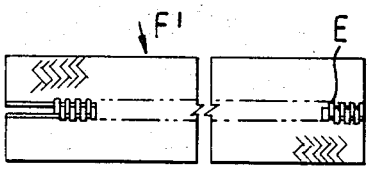
FIGS. 6C and 6D are views similar to FIG. 6B, each showing a slide fastener length of a pair of stringers having been cut from the slice fastener chain of FIG. 6A in a different fashion.
Figure 6D:
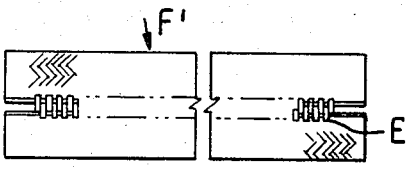
Figure 7B:
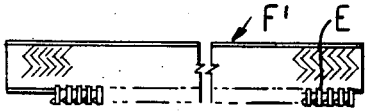
FIG. 7B shows a slide fastener length of stringer having been cut from the continuous stringer of FIG. 8A.

In FIGS. 5A, 6A, and 7A, reference character C is a cutting line along which the continuous fastener chain F is to be cut. FIGS. 5B, 6B, and 7B, respectively show an individual length of a pair of stringers F' having been severed from the respective fastener chain F of FIGS. 5A, 6A, and 7A along the cutting line C extending transversely across one of the successive spaced element-free gap portion S near the leading end of the succeeding pair of coupling element groups E. FIG. 6C shows an alternative form in which cutting has taken place along a transverse line in register with the leading end of the succeeding pair of coupling element groups E. In still another form of cutting, shown in FIG. 6D, severance has taken place along a transverse line extending centrally across one of the successive element-free gap sections E.

With particular reference to FIGS. 1–4, the apparatus generally comprises a frame 16 having a guide table 17 for supporting thereon a fastener chain F for movement along a horizontal path. A feeding unit 2 including upper and lower feed rollers 4, 20 conducts the fastener chain F longitudinally along the path over the guide table 17 in a predetermined direction, rightwardly in FIGS. 1–2, through a cutting station 3 and a detecting station 1 disposed downstream and upstream, respectively, of the feed unit 2. The upper roller 4 is a pressure roller, and the lower roller 20 is a driven roller adapted to be driven for rotation at a rate varying between a high speed, an intermediate speed, and a low speed.

The detecting station 1 serves to detect the arrival of each succeeding element-free gap section S at the detecting station and for changing the rate of rotation of the feed rollers 4, 20 step by step from the high speed to the low speed as the succeeding element-free gap section S approaches the cutting station. The detecting unit 1 includes a pair of parallel first and second sensing levers 8, 8' pivotally mounted on a support block 6 by a pair of pins 7, 7', respectively, and sloping down to the forward side at an acute angle relative to the fastener chain path.

Each of the first and second sensing levers 8, 8' has a tapered lower end portion 9, 9' which has in a bottom surface thereof a guide groove 10, 10' (FIGS. 3 and 4) of rectangular cross section for the passage of the successive pairs of interengaged coupling element groups E.

The detecting unit 1 also includes a pair of first and second sensors FS, FS' for sensing pivotal movement of the first and second sensing levers 8, 8', respectively. The first sensor FS comprises a first light emitter 12 disposed at one side of an upper end portion 11 of the first sensing lever 8, and a first photoelectric cell 13 disposed at the other side of the upper end portion 11 of the first sensing lever 8 for receiving light from the first light emitter 12. When the first sensing lever 8 is moved pivotally counterclockwise about the pin 7 in FIGS. 1, 2, and 4 as described below, the upper end portion 11 is retracted from the first sensor FS to allow light from the first light emitter 12 to reach the first photoelectric cell 13. Upon receipt of light from the first light emitter 12, the first photoelectric cell 13 produces a first command signal to change the rate of rotation of the driven roller 20 from the high speed to the intermediate speed.

Likewise, the second sensor FS' comprises a second light emitter 12' and a second photoelectric cell 13' disposed at opposite sides of an upper end portion 11' of the second sensing lever 8'. When the second sensing lever 8' is moved pivotally counterclockwise about the pin 7' in FIGS. 1, 2, and 4, as described below, the upper end portion 11' is retracted from the second sensor FS' to allow light from the second light emitter 12' to reach the second photoelectric cell 13'. Upon receipt of light from the second light emitter 12', the second photoelectric cell 13' produces a second command signal to change the rate of rotation of the driven roller 20 from the intermediate speed to the low speed.

The first and second sensing levers 8, 8' are normally urged by extension springs 14, 14' to pivot clockwise. Upward pivotal movement of the upper end portion 11, 11' of the respective sensing lever 8, 8' is restricted by a stop 15, 15' in the form of a screw adjustably threaded through the support block 6. By turning the stops 15, 15', the distance between the top surface of the guide table 17 and the lower end portion 9, 9' of each sensing lever 8, 8' is adjusted commensurate with the type and thickness of the slide fastener chain F to be cut. The position of the upper end portion 11, 11' of each sensing lever 8, 8' relative to the respective sensor FS, FS' also can be adjusted by turning the respective stops 15, 15'.

Figure 4:
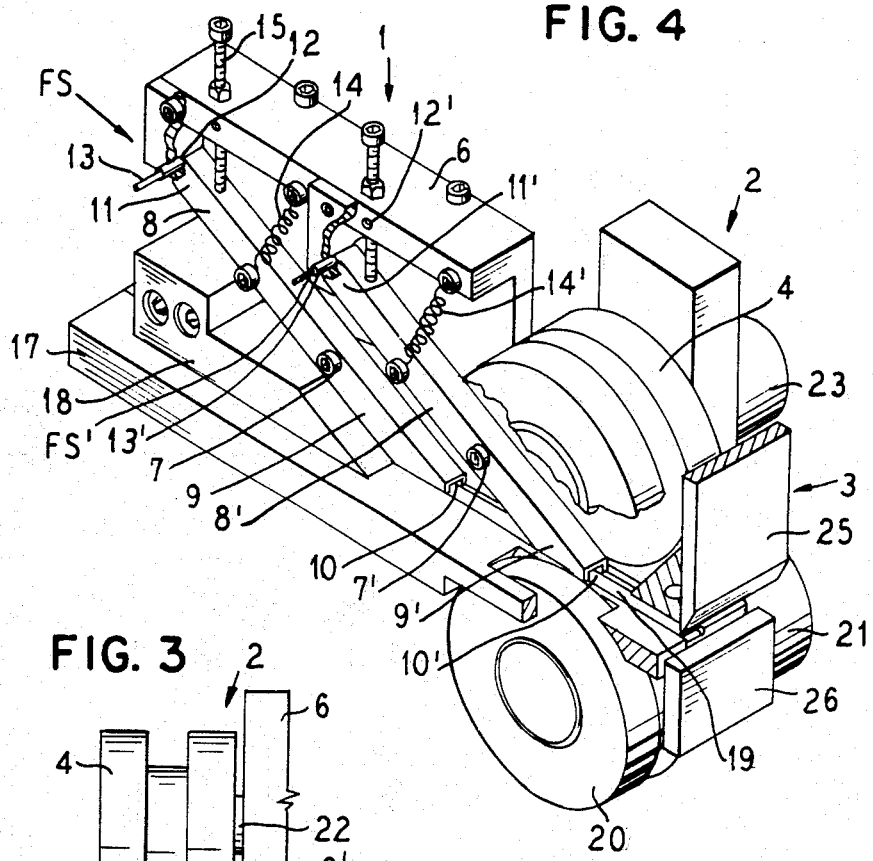
FIG. 4 is a perspective view of FIG. 1, with parts broken away, of FIG. 1.
Figure 3:
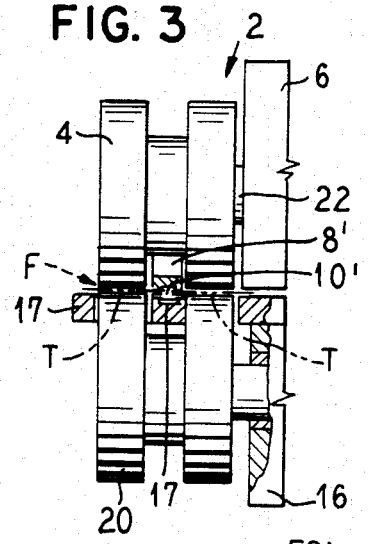
FIG. 3 is a cross-sectional view taken along line III—III of FIG. 1, with the pressure roller and a driven roller remaining unbroken.

As shown in FIGS. 3 and 4, the guide table 17 has a guide groove 19 extending centrally along the fastener chain path and having a width slightly larger than the width of the pair of interengaged coupling element groups E and substantially equal to the width of a bottom end stop B. A upper guide plate 18 and an auxiliary guide plate 24 are supported by the support block 6 and have respective bottom surfaces disposed in spaced confronting relation to the top surface of the guide table 17 when the support 6 is in its lowered position (FIG. 1) in a manner described below. If the fastener chain F of FIG. 6A is to be cut, the width of the guide groove 19 may be substantially equal to the width of a pair of interengaged coupling element groups E. Also, if only a continuous stringer as shown in FIG. 7A is to be cut, the width of the guide groove 19 may be substantially equal to the width of a single row of coupling elements E.

As shown in FIGS. 3 and 4, the pressure roller 4 has formed in its peripheral surface an annular center groove so that it can rotate without interference with the lower end portion 9' of the second sensing lever 8'. Likewise, the driven roller 20 has centrally in its peripheral surface an annular groove so that it can rotate without interference with the guide table 17. Thus each of the upper and lower feed rollers 4, 20 is divided into halves. Each stringer tape T is sandwiched or nipped between a respective half of the upper feed roller 4 and a corresponding half of the lower feed roller 20 as the fastener chain F is moved by the two feed rollers 4, 20. The lower or driven roller 20 is mounted on a shaft supported by the frame 16, while the upper or pressure roller 4 is mounted on a shaft 22 supported by the support 6 and normally urged toward the lower roller 20 by a non-illustrated spring.

A rotary encoder 23 is also mounted on the shaft 22 of the pressure roller 4 for producing a pulse every time a unit amount of the rotational movement of the pressure roller 4 occurs. The produced pulses may be counted by a non-illustrated counter of known type. When the number of the counted pulses reaches a predetermined value corresponding to the distance between a position where the leading end of a succeeding paid of coupling element groups E is sensed by the second sensing lever 8' and a predetermined position in the cutting station, the rotary encoder 23 produces a command signal to deenergize a drive source 21 (FIG. 4) to terminate rotation of the driven roller 20.

The cutting station 3 includes a pair of upper and lower cutting blades 25, 26. The lower cutting blade 26 is fixed to the frame 16 while the upper cutting blade 25 is disposed above the lower cutting blade 26 and is vertically movable toward and away from the lower cutting blade 26 by a suitable drive means, scuh as an air cylinder or a solenoid plunger.

Figure 1:
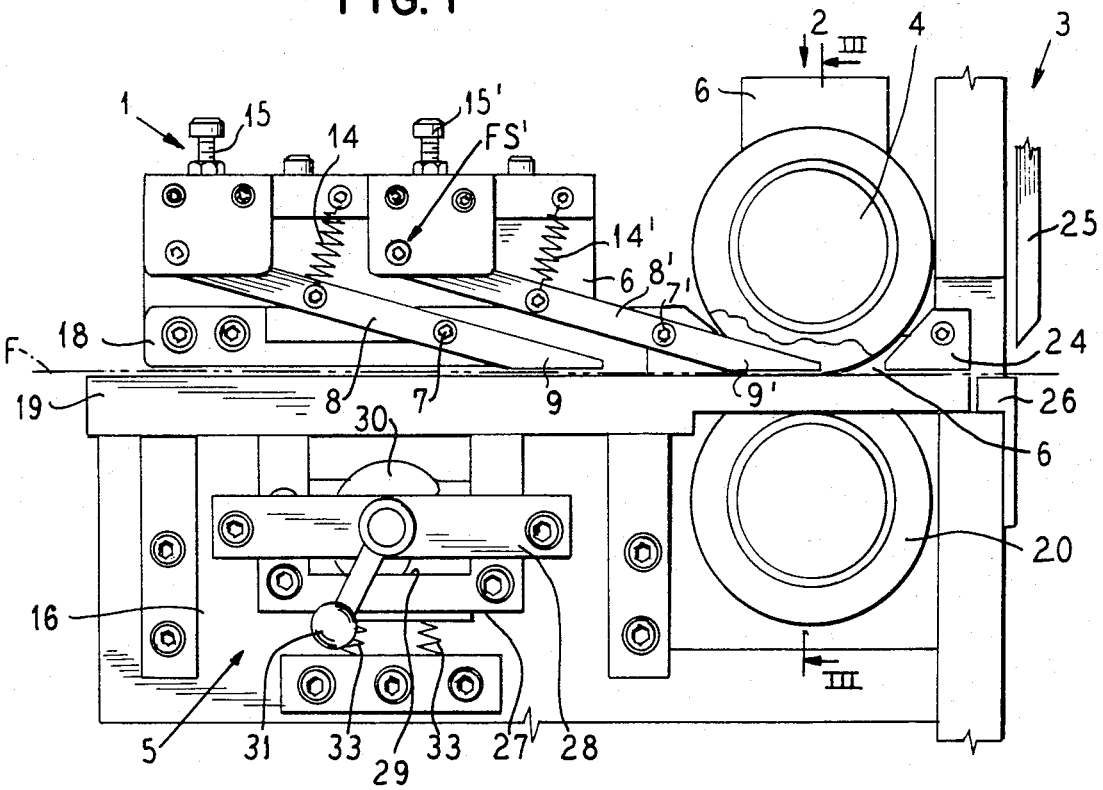
FIG. 1 is a fragmentary front view of a cutting apparatus embodying the present invention, with a detecting unit, a pressure roller, and an upper guide plate in lowered or operative position.
Figure 2:
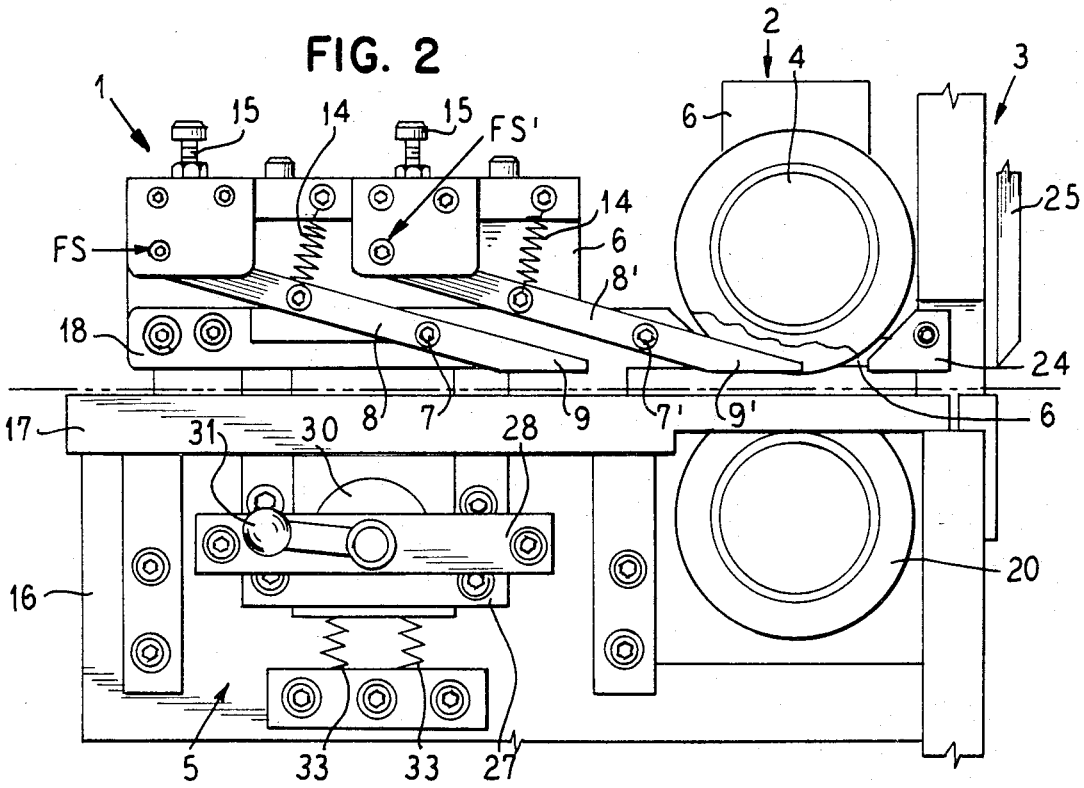
FIG. 2 is a fragmentary front view similar to FIG. 1 showing the detecting unit, the pressure roller, and the upper guide plate in raised or inoperative position.

The support block 6, with the upper guide plate 18, the detecting unit 1, the pressure roller 4 and the auxiliary guide plate 24, is movable by an elevating mechanism 5 between a lower or operative position (FIG. 1) and an upper or inoperative position (FIG. 2). The elevating mechanism 5 includes a U-shaped member 27 fixed to the support block 6, a horizontal bar 28 fixed to the frame 16 and holding the U-shaped member 27 for vertical movement, and a cam plate 30 turnably mounted on a midportion of the horizontal bar 28. The U-shaped member 27 is normally urged upwardly by a pair of compression springs 33, 33 so that an upper surface 29 of the horizontal side of the U-shaped member 27 is kept in contact with the peripheral cam surface of the cam plate 30. The cam plate 30 is turnable through a predetermined angle by manipulating a handle 31. In FIG. 1, when the handle 31 is angularly moved clockwise to turn the cam plate 30 in the same direction, the support 6 is moved upwardly by the bias of the compression springs 33. As a result, the upper guide plate 18, the first and second sensing levers 8, 8', the pressure roller 4 and the auxiliary guide plate 24 are brought to their upper or inoperative position (FIG. 2) so that the fastener chain F to be cut can be threaded through the apparatus easily. Then, when the cam plate 30 is turned counterclockwise by the handle 31 against the bias of the compression springs 33, the upper guide plate 18, the first and second sensing levers 8, 8', the support 6 is returned to its original, lowered position, thus bringing the upper guide plate 18, the first and second sensing levers 8, 8', the pressure roller 4 and the auxiliary guide plate 24 to their operative position (FIG. 1).

Figure 8A:
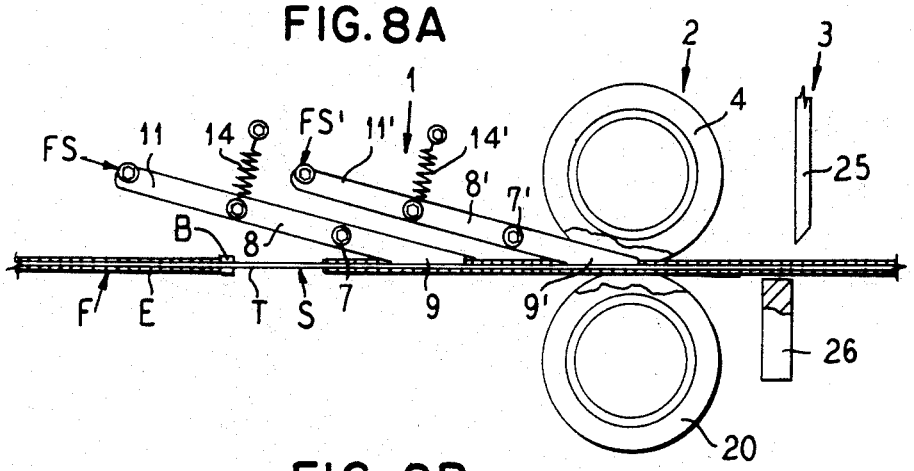
FIGS. 8A through 8F illustrate a sequence of steps of the present method, in which the fastener chain of FIG. 5A is cut.

In operation, a slide fastener chain F, such as, for example, as shown in FIG. 5A, is moved at a high speed forwardly or rightwardly along the path through the apparatus (FIG. 1) by the pressure and driven rollers 4, 20, as shown in FIG. 8A. When the bottom end stop B at the leading end of one of the successive pairs of interengaged coupling element groups E comes into engagement with the lower end portion 9 of the first sensing lever 8 at a first sensing position, the first sensing lever 8 is pivotally moved counterclockwise (FIG. 8B) against the bias of the extension spring 14 until the upper end portion 11 is retracted from the first sensor FS, allowing light from the first light emitter 12 to reach the photoelectric cell 13. Upon receipt of the light, the photoelectric cell 13 produces a first command signal to change the rate of rotation of the driven roller 20 from the high speed to an intermediate speed.

Subsequently, when the bottom end stop B then comes into engagement with the lower end portion 9' of the second sensing lever 8' at a second sensing position, the second sensing lever 8' is pivotally moved counterclockwise (FIG. 8C) against the bias of the extension spring 14' until the upper end portion 11 is retracted from the second sensor FS', allowing light from the second light emitter 12' to reach the photoelectric cell 13'. Upon receipt of the light, the photoelectric cell 13 produces a second command signal to change the rate of rotation of the driven roller 20 from the intermediate speed to the low speed. Thus the rate of movement of the fastener chain F is reduced step by step from the high speed to the low speed as the bottom end stop B and thus a preceding element-free gap section S contiguous thereto approaches the cutting station 3.

The second command signal is also applied to the non-illustrated counter to start counting the pulses produced by the encoder 23. When the number of the counted pulse reaches a predetermined value, the non-illustrated counter produces a command signal to stop rotation of the driven roller 20, the predetermined value corresponding to the distance between the second sensing station and a predetermined position in the cutting station. Thus the movement of the fastener chain F at the low speed continues until the bottom end stop B arrives at the predetermined position (FIG. 8D) in the cutting station. A preceding element-free gap section S contiguous to the bottom end stop B is thereby placed accurately in a desired position in the cutting station. The position in which the preceding element-free gap sectin S is to be placed can be adjusted by changing the predetermined value in the non-illustrated counter.

The command signal from the non-illustrated counter is also applied to the cutting unit 3 to energize the non-illustrated drive means thereof to lower the upper cutting blade 25 toward the lower cutting blade 26. As a result, the fastener chain F has been cut transversely across the preceding element-free gap section S (FIG. 8E), providing a slide fastener length of a pair of interengaged stringers F' (FIG. 5B). The upper cutting blade 25 then returns to its original or upper position (FIG. 8F).

Figure 8B:
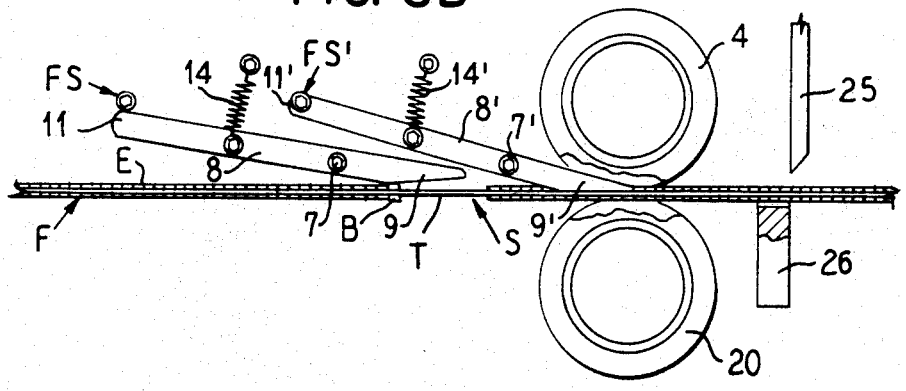
Figure 8C:
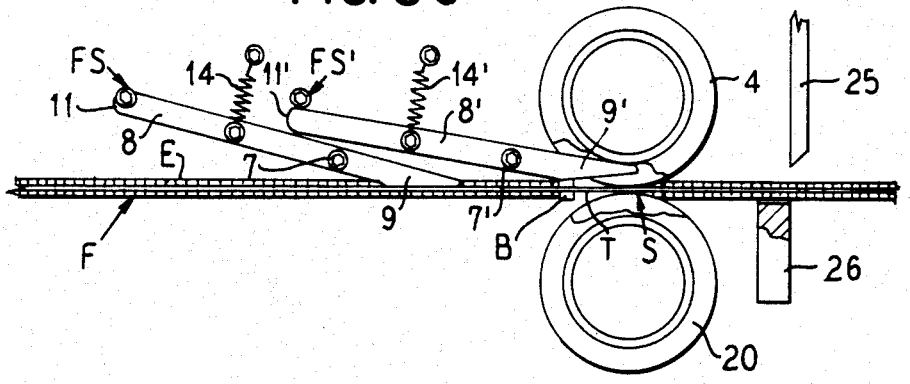
Figure 8D:
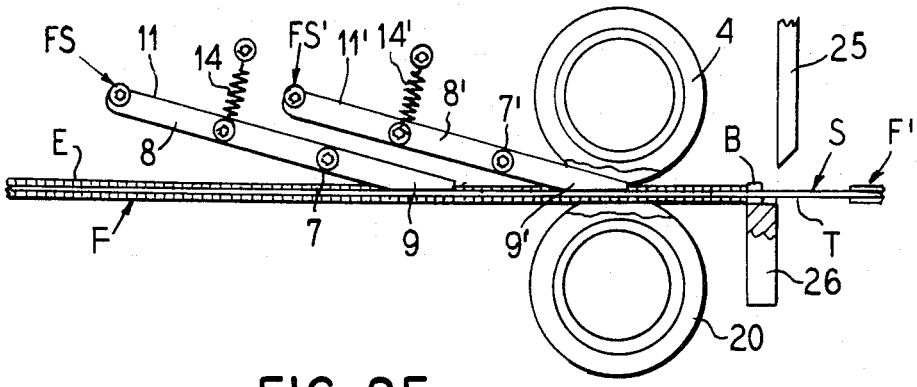
Figure 8E:
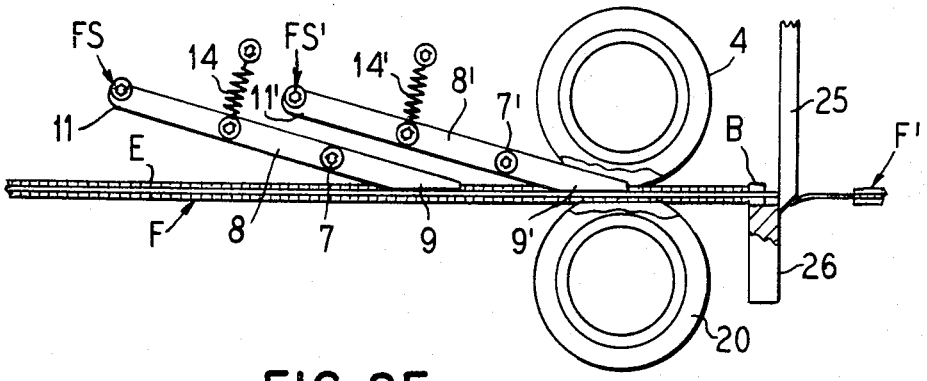
Figure 8F:
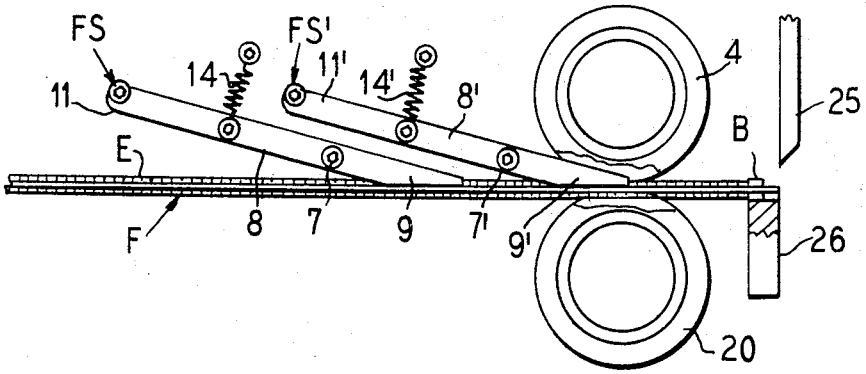

As shown in FIGS. 8B, 8C and 8D, as soon as the bottom end stop B has passed the first sensing position, the first sensing lever 8 is pivotally moved clockwise about the pin 7 to return its original position (FIG. 8A) and then continues to assume the same condition until a succeeding bottom end stop B arrives at the first sensing position. Likewise, as soon as the bottom end stop B has passed the second sensing position, the second sensing lever 8' returns to its original position (FIG. 8B) and then continues to assume the same condition until the succeeding bottom end stop B arrives at the second sensing position.

Figure 9:
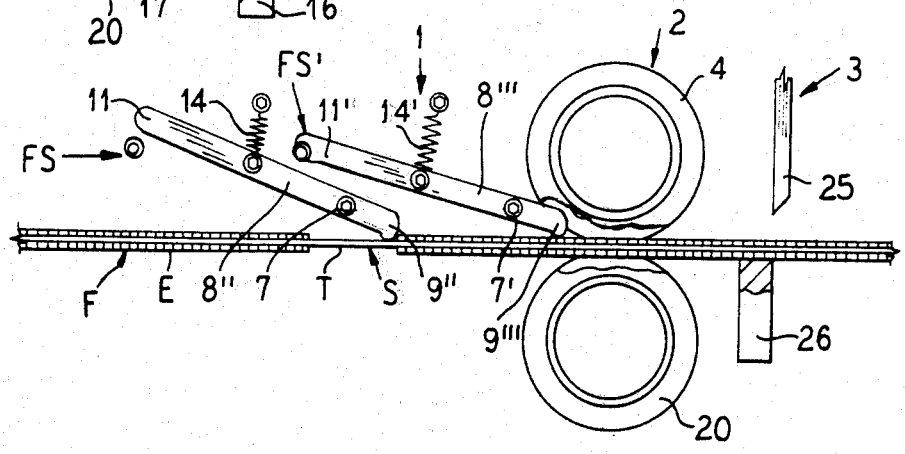
FIG. 9 is a view similar to FIG. 8B, illustrating another embodiment in which the fastener chain of FIG. 6A is cut.

FIG. 9 illustrates a modified detecting unit 1 which may be employed to detect the arrival of an element-free gap section S in the fastener chain F of FIG. 6A. The modified detecting unit 1 includes a first sensing lever 8'' pivotable on the pin 7 and having on its lower end portion 9'' a downwardly directed semi-circular projection, and a second sensing lever 8''' pivotable on the pin 7' and having on its lower end portion 9''' a downwardly directed semi-circular projection. When an element-free portion S arrives at the first sensing position, the semi-circular projection on the lower end portion 9'' of the first sensing lever 8'' falls from the upper surfaces of the coupling elements E onto the blank tape portions S, causing the first sensing lever 8'' to pivot clockwise until the upper end portion 11 is retracted from the first sensor FS. As soon as the element-free gap portion S has passed the first sensing position, the first sensing lever 8'' is pivotally moved counterclockwise to return to its original position and then continues to assume the same condition until the next element-free gap section S arrives at the first sensing position. In the same fashion, when an element-free gap section S arrives at the second sensing position, the second sensing lever 8''' is pivotally moved clockwise until the upper end portion 11' is retracted from the second sensor FS'. As soon as the element-free gap portion S has passed the second sening position, the second sensing lever 8''' returns to its original position and then continues to assume the same condition until the next element-free gap section S arrives at the second sensing position. This modified detecting unit 1 also may be employed to detect the arrival of the element-free gap section S in the continuous stringer of FIG. 7A.

In the first embodiment of FIG. 1, the arrival of an element-free gap section S is detected by sensing the difference in level between the upper surface of a bottom end stop B and the upper surface of the coupling elements E. In the embodiment shown in FIG. 9, the detection of the arrival of an element-free gap section S is effected by sensing the difference in level between the upper surfaces of the blank tape portions S and the upper surfaces of the coupling elements E.

FIGS. 10 and 11 illustrate an alternative detecting unit 1 which includes a first sensing member 36 carrying at its lower end a first roller 36, and a second sensing member 36' carrying at its lower end a second roller 36'. Each of the first and second sensing members 36, 36' is vertically slidably mounted in a tubular casing 34, 34' supported by a support block 6'. There is a compression spring 37, 37' acting between the respective tubular casing 34, 34' and the respective sensing member 36, 36' to normally urge the latter downwardly toward the guide groove 19 in the guide table 17. This downward movement of each sensing member 36, 36' is adjustably restricted by a pair of brackets 38, 38 and 38', 38' and a pair of associated screws (not numbered) each extending through a vertical slot in the respective bracket pairs 38, 38'. Further, each roller 35, 35' is carried by an auxiliary tubular part vertically adjustably mounted on the respective sensing member 36, 36' by a screw 42, 42'.

The detecting unit 1 of FIGS. 10 and 11 also includes a first light emitter 39 and a first photoelectric cell 40, both mounted on the first casing 34, and a second light emitter 39' and a second photoelectric cell 40', both mounted on the second second casing 34'. The first light emitter 39 is disposed at one side of the upper end portion of the first sensing member 36, while the first photoeletric cell 40 is disposed at the other side of the upper end portion of the first sensing member 36. The first sensing member 36 has in the upper end portion a horizontal through-hole 41 (FIG. 11). When an element-free gap section S arrives at the first sensing position, the first roller 35 of the first sensing member 36 moves vertically due to the difference in level between the upper surfaces of the blank tape portions S and the upper surfaces of the coupling elements E or the difference in level between the upper surface of the bottom end stop B and the upper surfaces of the coupling elements E. In response to the vertical movement of the first roller 35, the first sensing member 36 is also moved vertically between a first position in which the through-hole 41 is in alignment with the first light emitter 39 and the first photoelectric cell 40 to allow light from the first light emitter 39 to reach the first photoelectric cell 40, and a second position in whcih the through-hole 41 is out of alignment with the first light emitter 39 and the first photoelectric cell 40 to prevent light from the first light emitter 39 from reaching the first photoelectric cell 40. The sensing of an element-free gap section S by the second sensing member 36' takes place in the same manner as the first sensing member 36, and its detailed description is omitted here. The detecting unit 1 of FIGS. 10 and 11 can be employed to detect the arrival of an element-free gap portion S in the fastener chain F of FIGS. 5A, 6A, or 7A.

FIG. 12 illustrates another alternative detecting unit 1 which comprises first, second and third light emitters 43, 43', 43" supported by the upper guide plate 18 and facing the fastener chain path, and first, second and third photoelectric cells 44, 44' and 44" supported by the guide table 17 and the lower cutting blade 26 and facing the fastener chain path in vertical alignment with the first, second and third light emitters, 43, 43', 43", respectively. When an element-free gap section S arrives at the first sensing position, light from the first light emitter 43 passes through a space between a pair of opposed blank tape portions to reach the first photoelectric cell 44. Upon receipt of the light from the first light emitter 43, the first photoelectric cell 44 produces a first command signal to change the rate of rotation of the driven roller 20 from the high speed to the intermediate speed. Subsequently, when the element-free gap section S arrives at the second sensing position, light from the second light emitter 43' passes through the space between the pair of opposed blank tape portions to reach the second photoelectric cell 44'. Upon receipt of the light form the second light emitter 43', the second photoelectric cell 44' produces a second command to change the rate of rotation of the driven roller 20 from the intermediate speed to the low speed. Then the movement of the fastener chain F at the low speed continues until the element-free gap section S arrives at a predetermined position in the cutting station. Upon arrival of the element-free gap section S, light from the third light emitter 43" passes through the space between the pair of opposed blank tape portions to reach the third-photoeletric cell 44". Upon receipt of the light from the third light emitter 43", the third photoelectric cell 44" produces a third command signal to terminate the rotation of the driven roller 20. The third command signal is also applied to the non-illustrated drive means of the cutting unit 3 to lower the upper cutting blade 25 toward the lower cutting blade 26. The third sensing position is spaced apart from the actual cutting position. Therefore, if fastener chain F is to be cut along the cutting line C substantially aligned with the endmost coupling elements of the succeeding pair of coupling element groups E, a command delay timer may be connected to the third photoelectric cell 44".

According to the present method and apparatus described above, it is possible to place an elemnet-free gap section S accurately in a predetermined position in the cutting station, partly because the rate of movement of the fastener chain F is reduced step by step from a high speed to a low speed as the element-free gap section S approaches the cutting station and then the movement of the fastener chain F at the low speed continues until the element-free gap section S arrives at the predetermined position in the cutting station.

The present invention enables movement of the fastener chain F to be terminated accurately at a required position without any damage to the endmost coupling elements or a bottom end stop B near the leading end of the succeeding pair of coupling element groups E, and also without any separation along the leading end portion of the succeeding pair of coupling element groups E.

Further, since there is no finger or stop inserted in the space between a pair of opposed blank tape portions during cutting operation, each element-free gap section S can be severed at any region even near the leading end of a succeeding pair of coupling element groups E.

Therefore, uniform and adequate quality slide fasteners can be achieved without risk of reducing the rate of production.

It will be understood that various changes in the details, material, and arrangements of parts, which have been herein described and illustrated in order to explain the nature of the invention, may be made by those skilled in the art within the principle and scope of the invention. For example, in any of the embodiments described above, the light emitters and the photoelectric cells may be replaced with switches such as limit switches or proximity switches. Further, the rate of movement of the fastener chain may be reduced at four or more steps as an element-free gap section approaches the cutting station.

I claim as my invention:

1. An apparatus for cutting a continuous slide fastener into individual slide fastener lengths, the fastener having successive longitudinally spaced groups of coupling elements mounted on a stringer tape and element-free gap sections between the successive coupling element groups, said apparatus comprising:

a frame having a guide table for supporting the fastener thereon;

means for moving the fastener along a longitudinal path over said guide table in a predetermined direction to a cutting station, said moving means being operable to move the fastener at a rate varying from a high speed to a low speed;

a detecting station adjacent said cutting station and containing means for detecting when a leading end of one of said successive coupling element groups is in a position in said detecting station fully upstream of said cutting station and for rendering, in response to said detection, said moving means operative to move the fastener at a lower rate until a preceding element-free gap section contiguous to the leading end of said coupling element group arrives in said cutting station and a support means having at least part of said detecting means attached thereto overlying said guide table and adapted for being selectively raised relative to said guide table to permit thread-up of said fastener thereon prior to activation of said moving means;

means for deenergizing, upon said arrival of said preceding element-free gap section in said cutting station, said moving means to terminate the movement of the fastener; and a cutter blade means disposed in said cutting station for severing the fastener transversely across said preceding element-free gap section in response to termination of the movement of the fastener.

2. The apparatus of claim 1, wherein said fastener comprises a pair of continuous stringer tapes, the stringer tapes having successive spaced pairs of coupling element groups mounted thereon and interengaged with one another in opposed complementary fashion.

3. The apparatus of claim 2, wherein there is a bottom stop attached to each leading end of one of said successive pairs of coupling element groups, and said detecting of the leading end of said one coupling element group is detecting the leading end of said bottom stop attached thereto.

4. The apparatus of claim 1, wherein said detecting means includes a first sensing means for sensing the leading end of said one coupling element group at a first sensing position in said detecting station and response to said sensing to produce a first command signal to said moving means to change the moving rate of the fastener from said high speed to an intermediate speed, and a second sensing means for further sensing the leading end of said one coupling element group at a second sensing position downstream of said first sensing position in said detection station and responsive to said further sensing to produce a second command signal to said moving means to change the moving rate of the fastener from said intermediate speed to said low speed.

5. The apparatus of claim 4, wherein said fastener comprises a pair of continuous stringer tapes, the stringer tapes having successive spaced pairs of coupling element groups mounted thereon and interengaged with one another in opposed complementary fashion.

6. The apparatus of claim 5, wherein there is a bottom stop attached to each leading end of one of said successive pairs of coupling element groups, and said detecting of the leading end of said one coupling element group is detecting the leading end of said bottom stop attached thereto.

7. The apparatus of claim 4, wherein said first and second sensing means each comprise a pivotal lever arm, one end of which rides over said fastener under a bias force.

8. The apparatus of claim 4, wherein said first and second sensing means each comprise a photoelectric cell means.

9. The apparatus of claim 4, wherein said first and second sensing means each comprise a vertically reciprocable roller means for riding over said fastener under a bias force.

10. The apparatus of claim 4, wherein said means for deenergizing said moving means is activated by a counter which is engaged by the command signal of said second sensing means, said counter enabling said fastener to move a selective predetermined distance along said longitudinal path downstream of said second sensing means in said cutting station.

11. The apparatus of claim 4, wherein said support means comprises a support block overlying said guide table and having said first and second sensing means attached thereto.

* * * * *